US008564530B2

(12) United States Patent
Low et al.

(10) Patent No.: US 8,564,530 B2
(45) Date of Patent: Oct. 22, 2013

(54) AUTOMATIC CONFIGURATION OF UPDATE OPERATIONS FOR A BISTABLE, ELECTRO-OPTIC DISPLAY

(75) Inventors: Yun Shon Low, Richmond (CA); John Peter van Baarsen, Delta (CA)

(73) Assignee: Seiko Epson Corporation, Tokyo (JP)

( * ) Notice: Subject to any disclaimer, the term of this patent is extended or adjusted under 35 U.S.C. 154(b) by 836 days.

(21) Appl. No.: 12/100,267

(22) Filed: Apr. 9, 2008

(65) Prior Publication Data

US 2009/0256798 A1 Oct. 15, 2009

(51) Int. Cl.
*G09G 3/34* (2006.01)

(52) U.S. Cl.
USPC ..... 345/107

(58) Field of Classification Search
CPC ..... G02F 1/167
USPC ..... 345/107
See application file for complete search history.

(56) References Cited

U.S. PATENT DOCUMENTS

| | | | | |
|---|---|---|---|---|
| 6,531,997 | B1 | 3/2003 | Gates et al. | |
| 7,021,600 | B2 | 4/2006 | Yang | |
| 7,119,772 | B2 | 10/2006 | Amundson et al. | |
| 7,312,794 | B2 | 12/2007 | Zehner et al. | |
| 7,804,483 | B2 * | 9/2010 | Zhou et al. | 345/107 |
| 2006/0071921 | A1 * | 4/2006 | Park et al. | 345/204 |
| 2006/0232547 | A1 | 10/2006 | Johnson et al. | |
| 2007/0080926 | A1 | 4/2007 | Zhou et al. | |
| 2007/0085819 | A1 * | 4/2007 | Zhou et al. | 345/107 |
| 2007/0120813 | A1 | 5/2007 | Huitema et al. | |
| 2007/0205978 | A1 | 9/2007 | Zhou et al. | |
| 2008/0129667 | A1 * | 6/2008 | Zehner et al. | 345/87 |
| 2008/0238894 | A1 * | 10/2008 | Ng et al. | 345/204 |

FOREIGN PATENT DOCUMENTS

| | | |
|---|---|---|
| JP | 2007-507729 | 3/2007 |
| WO | 2005/031691 | 4/2005 |

OTHER PUBLICATIONS

Apollo Electrophoretic Display Controller, Philips, Feb. 10, 2004, Philips Emerging Display Technologies, Device Specification V1.0, (pp. 1-43).

* cited by examiner

*Primary Examiner* — Adam J Snyder

(57) ABSTRACT

An apparatus embodying principles of the invention includes first, second, and at least one pipeline units. The first unit generates synthesized pixel data from pixels of an image and pixels of a previous image. The second unit determines an update mode by comparing pixels of the image with corresponding pixels of the previous image to determine if at least one condition is true. The conditions may be configurable. In addition, the second unit selects an update mode from two or more update modes if the first condition is true. The pipeline unit determines a waveform for each pixel of the image and transmits the waveform as impulse data to a bistable, electro-optic display device. The apparatus may further include a pipeline selecting unit to select a pipeline from two or more pipelines according to the selected update mode.

6 Claims, 4 Drawing Sheets

AUTOMATIC CONFIGURATION OF UPDATE OPERATIONS FOR A BISTABLE, ELECTRO-OPTIC DISPLAY

FIELD

The present invention relates generally to bistable, electro-optic display devices and more particularly to automatically configuring update operations for a bistable, electro-optic display device.

BACKGROUND

A display device is comprised of an array of pixels. "Electro-optic" refers to an effect in which the optical properties of a material change in response to an electric field. Optical properties may include, but are not limited, to visual appearance. A display device in which the optical properties of the pixels may be made to change in response to an electric field is an electro-optic display device. Generally, if a pixel has two stable states, it may be considered bistable. However, the term "bistable" is used herein to mean multi-stable, i.e., pixels may have two or more stable states. For an optical property of a pixel to be considered stable, it is required that the property remain stable for a non-temporary period of time. Such a time period may be considered non-temporary if it is four times the minimum duration of a driving signal required to produce the electric field or fields needed to change the optical property of a pixel.

A variety of bistable, electro-optic display devices are known. One type of bistable, electro-optic display employs rotating bichromal bodies. A large number of small bodies having two or more sections with differing optical characteristics and an internal dipole are suspended in minute, liquid-filled cavities of a matrix. The bodies may be made to rotate by applying an electric field. Another type of bistable, electro-optic display uses an electrochromic medium. Yet another type of electro-optic display employs electro-wetting.

One type bistable, electro-optic display device is based on electrophoresis, that is, the movement of charged particles in response to an electric field. In displays of this type, charged particles are made to move through a fluid by application of an electric field. The fluid may be liquid or gas. The particles may be enclosed in a capsule, and the particles, fluid, capsules, and other elements may be collectively referred to as "encapsulated electrophoretic media." Typically, encapsulated electrophoretic media comprise numerous small capsules, and the capsules are held within a polymeric binder to form a coherent layer positioned between two electrodes. Displays of this type may be referred to as microencapsulated electrophoretic ("MEP") displays or electrophoretic displays ("EPDs").

A "micro-cell" electrophoretic display is another type of EPD. In a micro-cell electrophoretic display, the charged particles and the suspending fluid are retained within a plurality of cavities formed within a carrier medium, typically a polymeric film.

EPDs may be made so that they can be updated using a thin-film transistor ("TFT") array similar to those employed in active matrix LCDs, in which case the EPD may be referred to as an active matrix EPD ("AMPED"). EPDs are a promising technology for use in electronic readers or "e-books" because they provide good readability in a variety of lighting conditions, including sunlight. In addition, they consume low amounts of power compared with LCDs.

EPDs have been designed to operate using several different update modes. A "monochrome" update mode may be used to refresh an image comprised entirely of black and white pixels, such as text. An image of this type may also be referred to as a bi-level or bit-mapped image. A gray-scale update mode is used to refresh an image comprised of pixels that may be black, white, or a shade of gray in between black and white.

The time required to refresh an EPD in different update modes varies. For example, one exemplary monochrome update mode may require about one-third of the time an exemplary gray-scale update mode may require to update the EPD. It is generally desirable to use the fastest available update mode. However, the use of an incorrect update mode may result in image artifacts.

The image displayed on an EPD may only need to be refreshed every ten minutes or so, or when the image changes. For this reason, a CPU or other image data source generally needs to specifically request an image update. When the CPU requests an image update, it needs to specify an update mode and additional parameters.

There is a technical problem with known EPD s. Specifically, a CPU or other source of image data must specify an update mode and additional parameters. However, the information needed to determine the required update mode and other parameters may not be readily available to the CPU. Further, the determination of parameter values may place a significant burden on the CPU.

Accordingly, there is a need for methods and apparatus that simplify the interface between a CPU or other source of image data and a bistable, electro-optic display device, such as an EPD.

SUMMARY

An apparatus embodying principles of the invention includes first and second units, and at least one pipeline unit. The first unit generates synthesized pixel data from pixels of an image and pixels of a previous image. The second unit determines an update mode by comparing pixels of the image with corresponding pixels of the previous image to determine if at least one condition is true. The condition or conditions may be configurable. In addition, the second unit selects an update mode from two or more update modes if the first condition is true. The pipeline unit determines a waveform for each pixel of the image and transmits the waveform as impulse data to a bistable, electro-optic display device.

The apparatus may further include a pipeline selecting unit to select a pipeline from two or more pipelines according to the selected update mode.

A bistable, electro-optic display device and a method embodying principles of the invention are also disclosed.

Methods and apparatus according to the principles of the invention simplify the interface between a CPU or other source of image data ("host") and a bistable, electro-optic display device by freeing the host from having to determine the best update mode to use and which pipeline to use.

This summary is provided to generally describe what follows in the drawings and detailed description and is not intended to limit the scope of the invention. Objects, features, and advantages of the invention will be readily understood upon consideration of the following detailed description taken in conjunction with the accompanying drawings.

BRIEF DESCRIPTION OF THE DRAWINGS

In the drawings and description below, the same reference numbers are used in the drawings and the description generally to refer to the same or like parts, elements, or steps.

DETAILED DESCRIPTION

Figure 1:
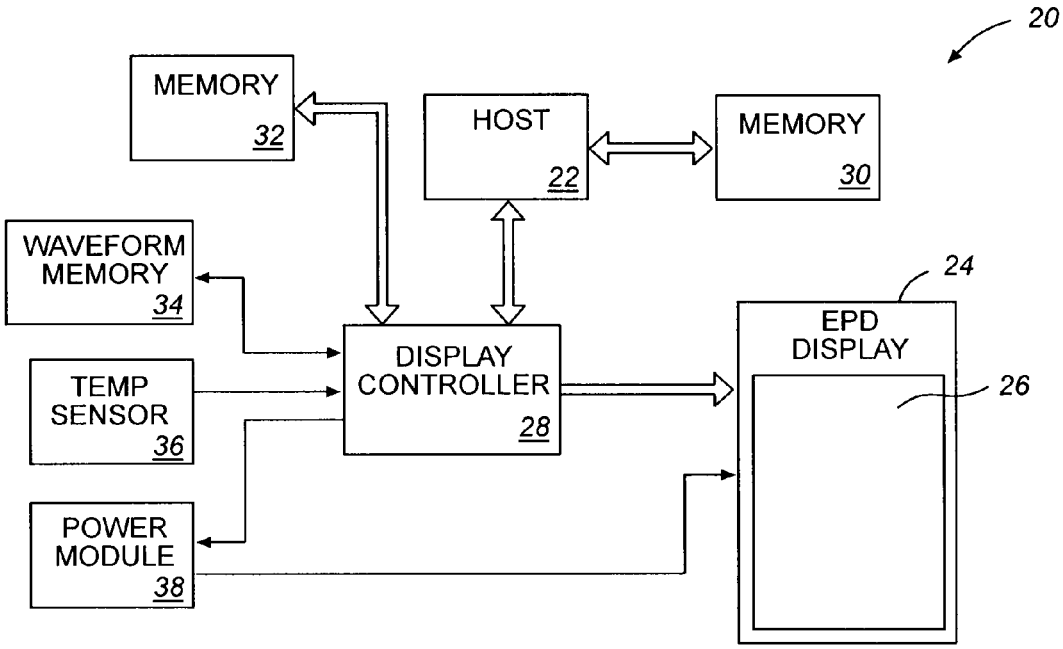
FIG. 1 is a block diagram of a system having a display device, display controller, and display memory according to one exemplary context for the present invention.

FIG. 1 is a block diagram of a system 20 comprising a host 22 and display device 24. The host 22 may be a CPU, DSP, or device capable of interfacing with a display controller. In one embodiment, the exemplary display device 24 may include a bistable, electro-optic display 26. The display 26 may be an electrophoretic display. The display 26 may be an AMPED or a passively driven electrophoretic display. The system 20 also includes a display controller 28, and a system memory 30. The system 20 also includes a display memory 32, a waveform memory 34, a temperature sensor 36, and a display power module 38.

Figure 2:
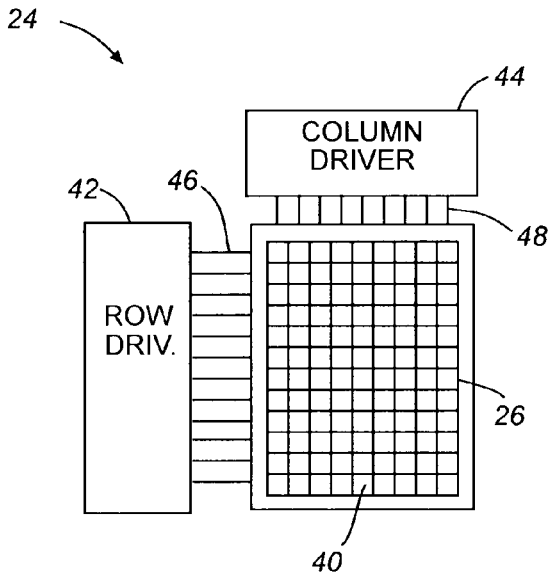
FIG. 2 is a schematic diagram showing the display device of FIG. 1 in more detail.

FIG. 2 is a schematic diagram showing the display device 24 in more detail. The bistable, electro-optic display 26 includes an array of pixels 40. Each pixel 40 may include an active switching element (not shown), such as a TFT. The switching elements are selected and driven by a row driver 42 and a column driver 44. In operation, the row driver 42 may select row electrodes 46, turning on all of the switching elements in the row. The column driver 44 may provide an impulse data signal on a selected column electrode 48, thereby providing an impulse voltage to the pixel located at the intersection of selected row and column electrodes.

Figure 3:
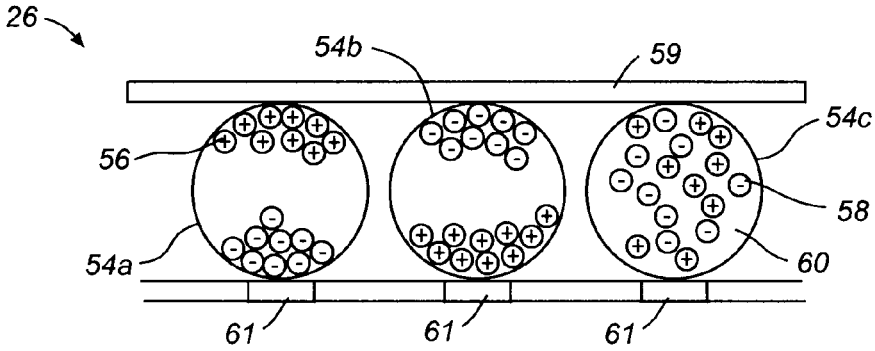
FIG. 3 is a schematic diagram showing a simplified portion of electrophoretic media of the display device of FIG. 2.

FIG. 3 is a schematic diagram showing a simplified portion of the display 26 in cross-section. The representation shown in FIG. 3 corresponds with one embodiment of an active-matrix electrophoretic display. One or more microcapsules 54 are sandwiched between the pixel electrodes 59, 61. The pixel electrode 59 may be transparent. In practice, each pixel may correspond with more than two microcapsules. Each microcapsule 54 may include positively charged white particles 56 and negatively charged black particles 58 suspended in a fluid 60. The pixel electrode 59 may be held at a predetermined voltage, and the row and column electrodes 46, 48 may be used to control the voltage applied to the electrodes 61. The pixel electrodes 59, 61 may be used to establish an electric field across the microcapsules 54 associated with a particular pixel. When the electric field is positive, the white particles 56 move toward the electrode 46, which results in the pixel becoming whiter in appearance. On the other hand, when the electric field is negative, the black particles 58 move toward the electrode 46, which results in the pixel becoming blacker in appearance. The microcapsule 54*a* is a simplified representation of a pixel that is completely white and the microcapsule 54*b* is a simplified representation of a pixel that is completely black. In addition, the microcapsule 54*c* illustrates a pixel having a gray-scale value other than completely white or black, i.e., gray. To generate a pixel having a particular optical appearance, e.g., black, white, or gray, a sequence of voltage pulses is typically applied to the pixel electrodes. The particular sequence of voltage pulses or waveform depends on, among other things, the desired new optical appearance for the pixel. When the exemplary EPD panel 26 is updated, a waveform may be applied to each pixel of the display, the particular waveform corresponding with pixel's new appearance.

A pixel may be driven to a black, white, or shade of gray intensity by applying a voltage pulse of appropriate polarity, duration, and amplitude to the electrodes of the pixel. The voltage pulse applied to a pixel may be modulated as to duration, amplitude, or both duration and amplitude. Moreover, the voltage pulse may be applied as single pulse or as two or more discrete pulses which approximate the single pulse.

In practice, the pixels in an electrophoretic display are typically driven by a pulse-train or "waveform." The waveform used to drive a particular pixel depends on the new appearance or optical state of the pixel and a variety of other factors. One significant factor is the initial (or current) optical state of the pixel, as well as earlier optical states of the pixel. Other factors include temperature, and dwell time, i.e., how long the pixel was in the initial state before being driven to the new state.

EPDs may operate using several different update modes. A monochrome update mode may be used to refresh a bi-level image. A gray-scale update mode is used to refresh an image comprised of pixels that may be black, white, or a shade of gray in between black and white. A pen mode may be used to refresh an image that may be either bi-level or comprised of a plurality of gray levels. The pen mode updates the current image with bi-level pixels. Other update modes include modes in which the entire display is driven to white, black, or shade of gray. Each update mode employs a different drive scheme.

A drive scheme is the set of waveforms to drive any particular pixel from all possible optical states that the pixel may currently occupy to any possible new optical state. In other words, a drive scheme includes one waveform form for each possible pixel transition. The number of possible pixel transitions depends on the number of optical states that a specific electrophoretic display is capable of displaying. For bi-level pixels, there are two possible optical states and two possible transitions, black-to-white and white-to black. Thus, a bi-level drive scheme may comprise two waveforms. For 2-bit pixels, there are four possible states (black, dark-gray, light-gray, and white) and sixteen possible transitions. For 8-bit pixels, there are 64 four possible states and 4,096 possible transitions.

An update mode may include two or more sets of waveforms, each set for use with a specific type of electrophoretic display being operated in a specific environment, e.g., at specific temperatures. In the descriptions that follow, the terms "pipes" and "pipelines" will be used interchangeably. Also, the terms "pipe," "update pipe," and "update display pipe" will be used interchangeably.

Figure 4:
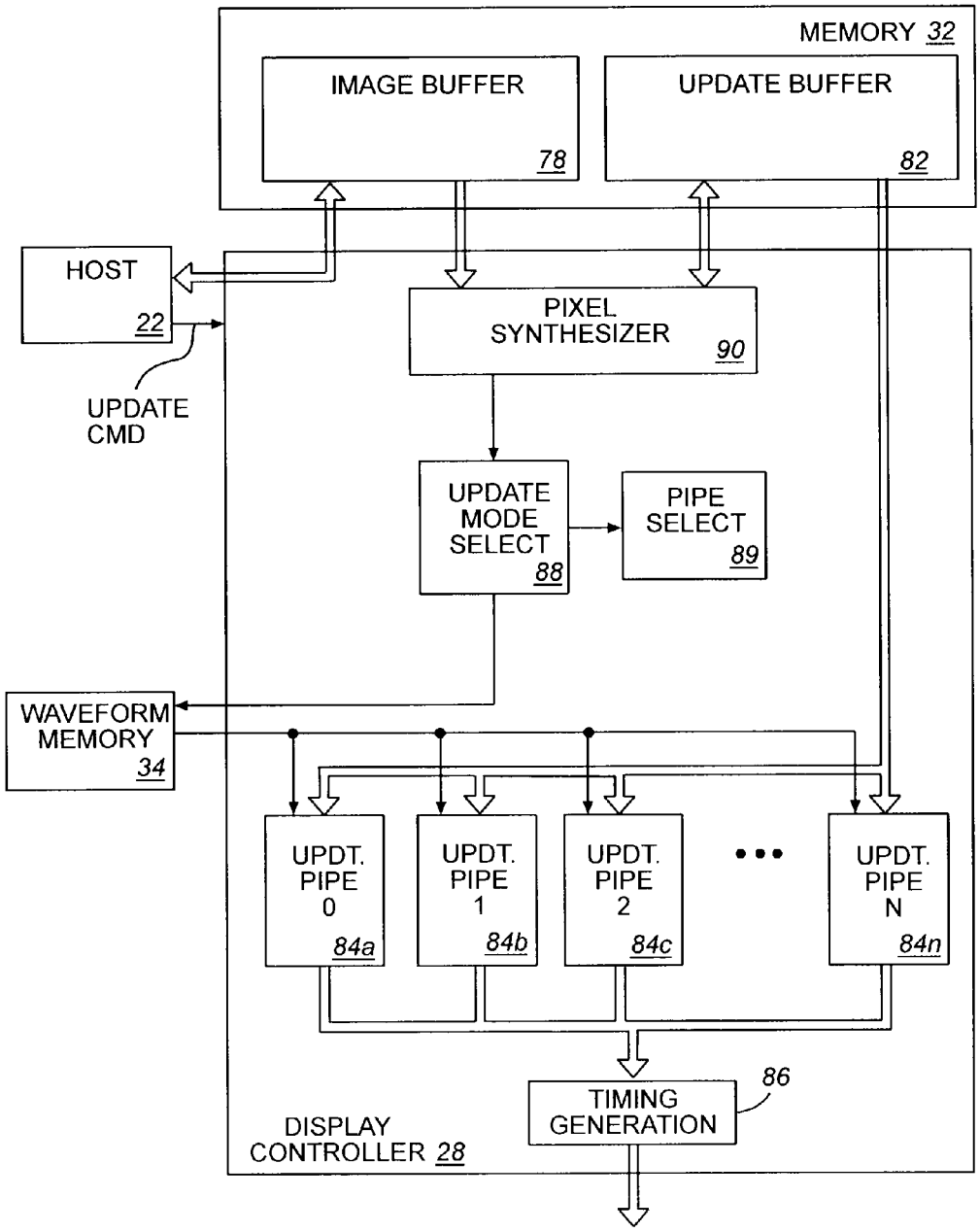
FIG. 4 is a block diagram showing the display controller and display memory of FIG. 1 in greater detail.

FIG. 4 is a block diagram showing the display controller 28 and display memory 32 in greater detail. The display memory 32 includes an image buffer 78 and an update buffer 82. The display memory 32 may be RAM. In addition, it is not critical that the image buffer 78 and an update buffer 82 reside in the same memory element. The host 22 or other image data source may store an image or a portion of an image in the image buffer 78, which may be pixel data. The image buffer may be accessed at most times during a refresh operation. (One exception relates to a pixel synthesis operation described below.) Thus, the host 22 may treat the image buffer 78 like a conventional frame buffer. The update buffer 82 stores pixel transitions with respect to a current and next image. A pixel transition is comprised of a current optical state and a next optical state for a particular pixel. Specifically, then the update buffer 82 stores a next pixel NP and a current pixel CP for each pixel in the display. The update buffer 82 may be accessed by internal components of the display controller 28, such as a pixel synthesizer 90 or an update pipe 84. The display controller 28 may include just one update pipe 84. Alternatively, the display controller 28 may include two or more update pipes 84. In one embodiment, the display controller 28 includes sixteen update pipes 84. While the update pipelines 84 may be assigned to particular regions of the display, this is not required. In particular, it is explained below how the update pipelines 84 may be selected so that they may be used to update any region of the display. The outputs of the update pipes 84 are coupled with a timing generation unit 86.

A refresh operation typically begins after the host 22 has sent new pixels to the display controller 28, which are stored in the image buffer 78. The host 22 may store a full frame or less than a full frame in the image buffer 78. The host 22 may initiate a refresh operation at any time by sending the display controller 28 a "display image" or a "display partial image" command.

During an update operation, the pixel synthesizer 90 synthesizes pixel data to be used in the refresh operation, an update mode select unit 88 may select an update mode, and a pipe select unit 89 may select an update pipe 84.

In a refresh operation, the pixel synthesizer 90 fetches pixels from the image buffer 78 and the update buffer 82. At the instant a refresh operation is started, the next pixel NP corresponds with a pixel currently being displayed, and the current pixel CP corresponds with the previous optical state of the pixel. The pixel synthesizer 90 fetches a new pixel from the image buffer 78 and a corresponding next pixel NP from the update buffer 82. The pixel synthesizer 90 then stores the fetched pixels in the update buffer 82. In the synthesis operation, the new pixel fetched from the image buffer 78 is stored as a next pixel NP in the update buffer 90. The next pixel NP fetched from the update buffer 90 is stored as a current pixel CP in the update buffer 90, replacing the previously stored CP. In this way, the pixel synthesizer 90 stores pixel transitions with respect to the currently displayed and the next to be displayed images. The new NP, CP pair of pixels together defines a new pixel transition that may be used as an index for looking up waveform data. While the image buffer 78 may be unavailable to the host 22 during the pixel synthesis operation, generally speaking, the synthesis operation may be performed quickly and consumes only a small portion of the total refresh operation time.

Figure 5:
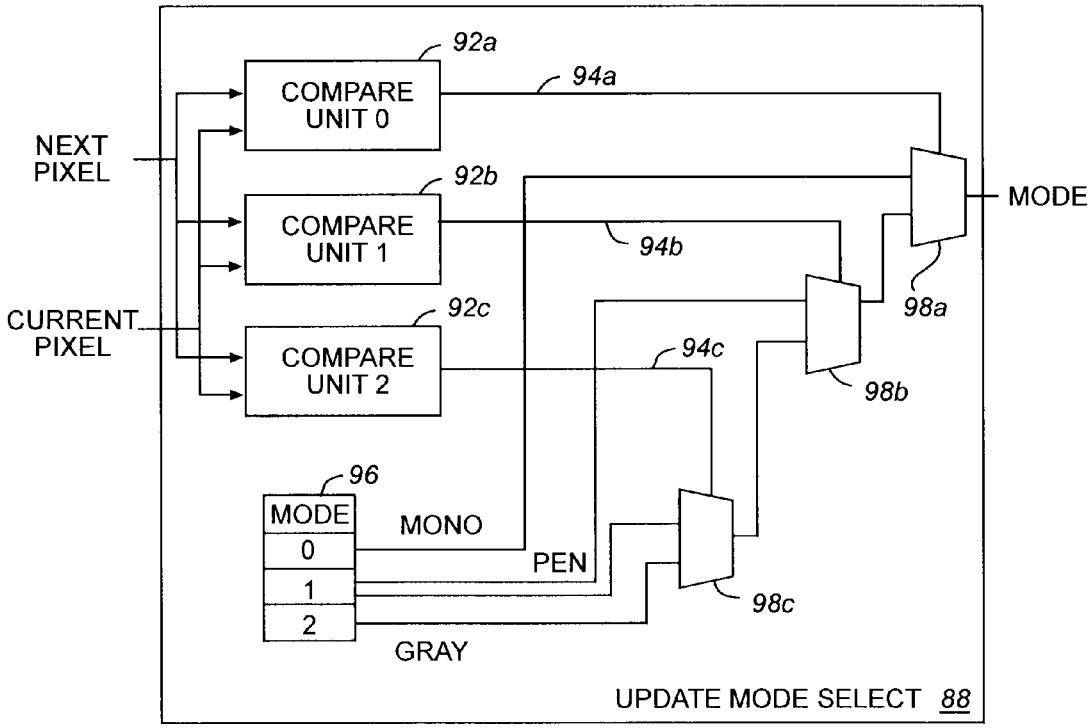
FIG. 5 is a block diagram showing an update mode select unit of the display controller of FIG. 4, the update mode select unit including a plurality of compare units.

The update mode select unit 88 may select an update mode. Turning to FIG. 5, the update mode select unit 88 is shown in greater detail. The update mode select unit 88 includes, in one embodiment, compare units 92*a*-92*c*. In alternative implementations, additional or fewer compare units 92 may be provided. The update mode select unit 88 also includes register 96 for storing values representative of update modes, and selecting units 98. The update mode select unit processes pixels one at a time. In one embodiment, a next pixel NP and a corresponding current pixel CP value are provided to each of the compare units 92 by the pixel synthesizer 90. In this embodiment, the pixel synthesizer and the update mode select unit may operate simultaneously. In one alternative, the update mode select unit 88 may obtain next and current pixels NP, CP from the update buffer 82.

Figure 6:
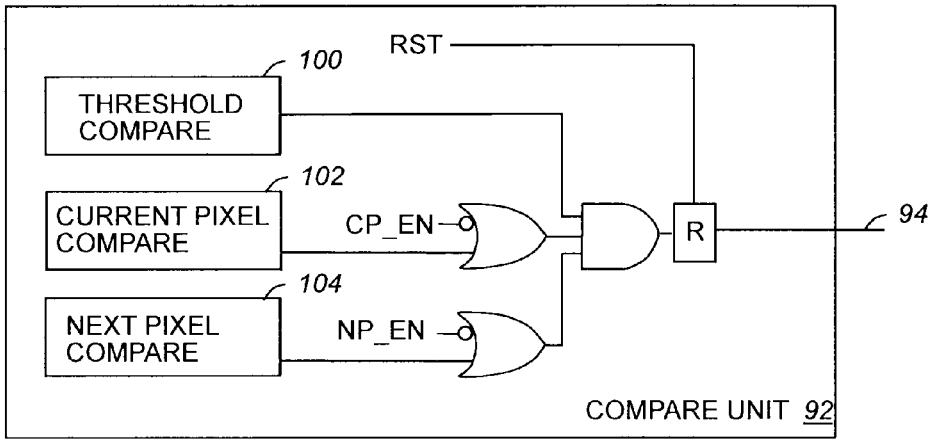
FIG. 6 is a block diagram showing an exemplary compare unit of FIG. 5 in greater detail.

An exemplary compare unit 92 is shown in greater detail in FIG. 6. Each compare unit 92 includes three compare modules: a threshold compare module 100, a current pixel compare module 102, and a next pixel compare module 104. Each module is configurable. In one embodiment, a module may be configured with parameters using control bits specified by the host 22 or by another device. Additional compare units may be provided.

The parameter for the threshold compare module 100 may be the minimum pixel value difference between the current and next pixel. In one embodiment, the parameter may take any value between 0 and 255. If the difference between the current and next pixel is greater than or equal to the difference parameter, then the result of the comparison is true and the threshold compare module 100 asserts a one on its output. Otherwise, it is false, i.e., zero. As one example, if the difference parameter is set to 255, then the comparison result is only true in two cases: if CP=0 and NP=255, or if CP=255 and NP=0. In one alternative, a maximum pixel value difference may be substituted for the minimum difference.

The parameter for the current pixel compare module 102 may be a value for the current pixel. If the current pixel CP is equal to the current pixel parameter value, the comparison result is true and the current pixel compare module 102 outputs a one. Otherwise, a zero is output. As one example, if pixel states are defined by eight bits and if the CP compare parameter is set to 255, then the comparison result is true in 256 cases: if CP=255 and NP=0-255. In one alternative, the parameter for the current pixel compare module 102 may be a value for a pixel earlier in time than the current pixel, e.g., the pixel value immediately preceding the current pixel value.

Similarly, the parameter for the next pixel compare module 104 may be a value for the next pixel. If the next pixel NP is equal to the next pixel parameter value, the comparison result is true and the next pixel compare module 104 asserts a one on its output. Otherwise, a zero is output. For instance, if pixel states are defined by eight bits and if the NP compare parameter is set to 255, then the comparison result is true in 256 cases: if CP=0-255 and NP=255.

The threshold compare module 100 is always enabled, but it may be effectively disabled by specifying the difference as zero. The next and current pixel compare modules 102, 104 may be enabled or disabled by the signals CP_EN signal and NP_EN respectively. In operation, a register R is reset to a logic 1 (or true) at the start of a new frame. If at any time during the pixel-by-pixel comparison process, a comparison result is false, the register R is reset to a logic 2 (or false). The threshold compare module 100 may be used to detect a monochrome type pixel transitions and that the compare modules 102, 104 may be used to detect pen type pixel transitions. It may be seen that the modules may be programmed to detect a wide variety of other pixel transitions.

Referring again to FIG. 5, the compare units 92*a*-92*c* are configured in a manner in which the compare units are assigned priorities. The unit 92*a* has the highest priority. If its output on line 94*a* is high (true), then mode 0 is selected by the selecting unit 98*a*. The unit 92*b* has the next highest priority. If the output of unit 92*a* on line 94*a* is low (false), then the output of selecting unit 98*b* is selected by the selecting unit 98*a*. This in turn causes mode 1 to be passed to the output of the update mode select unit 88 if the output of the compare unit 92*b* on line 94*b* is high (true). The compare unit 92*c* has third priority. If all three compare units 92*a*-*c* have false signals on their outputs, the default mode of 2 is passed to the output of the update mode select unit 88. In one alternative, the compare units 92*a*-92*c* may be configured in a manner such that the relative priorities of the units differ from that shown in FIG. 5.

Table 1 below further illustrates the operation of the update mode select unit 88 of FIG. 2 by way of one example in which pixel states are defined by eight bits.

TABLE 1

| Compare Unit | Threshold Compare Parameter | CP Compare | NP Compare | Waveform Set |
|---|---|---|---|---|
| 0 | 255 | Disable | Disable | Mono |
| 1 | 1 | Disable | 255 | Pen |
| 2 | 1 | Disable | 1 | Pen |
| 3 | 1 | Disable | Disable | Gray |

As can be seen from Table 1, the compare unit 0 detects only the pixel transitions from black-to-white and from white-to-black. If these are the only transitions in the update area, the Mono Update (MU) set of waveforms are selected. The compare units 1 and 2 each detect one-half of all possible Pen Update (PU) type transitions.

A refresh operation may update the full display area. Alternatively, the full display area may be divided into two or more sub-areas or regions. The host 22 may use the display partial image command to display one region of a full frame. An update pipe 84 may be used to refresh the full display area or one region of the full display area.

In one embodiment, the refresh operations for two or more regions may proceed in parallel, each update being performed by a separate update pipe 84. In addition, the refresh operation for each region may use a different update mode. The update mode select unit 88 may be employed to determine an update mode for a full frame. Alternatively, the update mode select unit 88 may be employed to determine an update mode for one or more regions of a frame.

One advantage of the update mode select unit 88 is that it frees the host 22 from having to determine the best update mode to use. In addition, software operating on the host 22 may be comprised of layers, where a lower layer provides a service to a higher layer, but at the same time shields or hides implementation details from the higher layer. The update mode select unit 88 permits the use of display image and display partial image commands by software operating at a higher level without requiring that the software keep track of previous images so as to be able to determine the fastest update mode. Not only does this simplify the design of higher level software, it provides a safeguard against inadvertent mistakes by software in selecting a non-permitted update mode. Moreover, the configurability of the update mode select unit 88 provides a substantial advantage because the display controller 28 may be easily adapted for use with update modes other than those described herein or with newly developed update modes as they become available.

In one embodiment, the pipe select unit 89 selects an update pipe 84. The output of the update mode select unit 88, i.e., the best update mode for a full frame or a region, is provided to the pipe select unit 89. The pipe select unit 89 may use the update mode so provided to select an update pipe. One possible way that the pipe select unit 89 may select an update pipe is shown in Table 2 below.

TABLE 2

| Compare Logic | Update Mode | Update Pipe |
|---|---|---|
| 0 | Mono Update | 0-3 |
| 1 | Pen Update | 4-5 |
| 2 | Pen Update | 6-8 |

TABLE 2-continued

| Compare Logic | Update Mode | Update Pipe |
|---|---|---|
| 3 | Gray-Scale Update | 9-16 |

The exemplary pipe allocation scheme shown in Table 2 assumes that sixteen update pipes 84 are provided in the display controller 28. The scheme shown in Table 2 is effective to balance the load of updating the display 26 because the relatively fast update modes are provided with relatively fewer update pipes, while the relatively slow update mode is provided with relatively more update pipes. Specifically, the mono and pen update modes may, in one embodiment, require on the order of 260 ms, and the gray-scale update mode requires on the order of 800 ms. In other words, a refresh operation in gray-scale update mode may take three times as long as a refresh operation in one of the other update modes, irrespective of size of the region to be updated. (The time period for a refresh operation is generally about the same without regard to the number of pixels being updated.) By allocating fifty percent of the available update pipes 84 to the update mode that takes three times as long as the other update modes, it is unlikely that the display partial image command will have to wait because all available display pipes are busy.

While the allocation scheme described above has been provided as one example, it will be appreciated that other possible allocation schemes, providing similar load balancing benefits may be implemented using the determined update mode. Other allocation schemes may take into account the expected types of updates in a particular application.

In operation, an update pipe 84 selected by the pipe select unit 89 reads synthesized pixel data for its assigned region from the update buffer 82 and generates waveforms for the pixels of the specified region.

One advantage of the pipe select unit 89 is that it frees the host 22 from having to determine which update pipe 84 to use when it issues a display full or partial image command. Another advantage of the pipe select unit 89 is that it is unlikely that a display image command will need to wait for a free update display pipe 84.

To generate waveforms, each pixel transition is used as a waveform lookup table index. Waveforms may be stored in the waveform memory 34. In one embodiment, the memory 34 may be a serial flash memory. An update pipe 84 locates the set of all possible waveforms in the waveform memory 34 corresponding with a specified update mode provided to the pipe by the update mode select unit 88.

The array of pixels or "frame" which makes up the display are addressed in raster order. The amount of time it takes to scan all of the pixels in the frame is the frame period. If the waveform is comprised of a single pulse, the waveform may have a duration of one frame. However, waveforms typically have two or more pulses, and accordingly, a waveform is typically presented to the display 26 in two or more frames.

The voltage of the pulses in a frame may be a single voltage amplitude having either a positive or negative polarity. For example, the voltage amplitude may be either +15V, −15V. Alternatively, the voltage of the pulses may be a positive or negative voltage, or zero volts. For example, the voltage amplitude may be either +15V, −15V, or 0V. However, it is not required that pulses be limited to two or three possible amplitudes. A waveform for driving a pixel may have as many different amplitude magnitudes as desired.

For each frame in the update mode period, the pipe 84 copies the impulses for all of the pixel transitions for the current frame and stores the current frame impulses in a lookup table within the pipe. However, the pipe 84 does not copy entire waveforms in each frame; only the portion of the waveform pertinent to the current frame is copied, e.g., one pulse. In addition, for each frame, the update pipe 84 fetches pixel transitions for its assigned region from the update buffer 82 in raster order. Using the current frame impulse data stored in the lookup table in the pipe, the update pipe 84 locates impulse data for the current frame corresponding with each fetched pixel transition. The update pipe 84 provides the impulse data to the timing generation unit 86.

The timing generation unit 86 steps through the locations of an image in raster order every frame period, selecting impulse data corresponding with the current pixel position from one of the update pipes 84. The timing generation unit 86 is provided with coordinate locations of each designated region along with the update pipe 84 to which the region has been assigned. The timing generation unit 86 provides the selected impulse data to the display panel 26 and the display power module 38.

It will be appreciated that the system 20 may include components in addition to those described above. In addition, the display controller 26 may include additional modules, units, or components. In order to not needlessly complicate the present disclosure, only modules, units, or components believed to be necessary for understanding the principles of the claimed inventions have been described.

In one embodiment, the update mode select module or the pipe select module may perform some or all of the operations and methods described in this description by executing instructions that are stored in or on machine-readable media.

In this description, references may be made to "one embodiment" or "an embodiment." These references mean that a particular feature, structure, or characteristic described in connection with the embodiment is included in at least one embodiment of the claimed inventions. Thus, the phrases "in one embodiment" or "an embodiment" in various places are not necessarily all referring to the same embodiment. Furthermore, particular features, structures, or characteristics may be combined in one or more embodiments.

Although embodiments have been described in some detail for purposes of clarity of understanding, it will be apparent that certain changes and modifications may be practiced within the scope of the appended claims. Accordingly, the described embodiments are to be considered as illustrative and not restrictive, and the claimed inventions are not to be limited to the details given herein, but may be modified within the scope and equivalents of the appended claims. Further, the terms and expressions which have been employed in the foregoing specification are used as terms of description and not of limitation, and there is no intention in the use of such terms and expressions to exclude equivalents of the features shown and described or portions thereof, it being recognized that the scope of the inventions are defined and limited only by the claims which follow.

We claim:

1. A method for updating a bistable, electro-optic display device, comprising:

(a) receiving a command to display an image;

(b) generating synthesized pixel data from pixels of the image and pixels of a previous image;

(c) comparing a first pixel of the image with a corresponding pixel of the previous image to determine if one of a first and a second condition is true, and selecting a monochrome update mode as a first update mode when the first condition is true, a pen update mode as the first update mode when the second condition is true, the second condition being determined only when the first condition is not true, and a gray-scale update mode as the first update mode when both of the first and second conditions are not true, (d) comparing a second pixel of the image with a corresponding pixel of the previous image to determine if one of a third and a fourth condition is true, and selecting the monochrome update mode as a second update mode when the third condition is true, the pen update mode as the second update mode when the fourth condition is true, the fourth condition being determined only when the third condition is not true, and the gray-scale update mode as the second update mode when both of the third and fourth conditions are not true; and (e) causing a first pipeline to determine a waveform for the first pixel of the image in accordance with the first update mode and to transmit the waveform as impulse data to the display device during a first period, and causing a second pipeline to determine a waveform for the second pixel of the image in accordance with the second update mode and to transmit the waveform as impulse data to the display device during a second period, wherein the first condition is that each of the first pixel of the image and the corresponding pixel of the previous image is white or black, wherein the second condition is that the first pixel of the image is white or black, wherein the third condition is that each of the second pixel of the image and the corresponding pixel of the previous image is white or black, wherein the fourth condition is that the second pixel of the image is white or black, wherein the first update mode is different from the second update mode, wherein the first period and the second period at least partially coincide in time, wherein each of the first pipeline and the second pipeline is used to update an arbitrary display region of the display device, and wherein a number of the pipelines allocated for the gray-scale update mode is larger than a number of the pipelines allocated for the monochrome update mode.

2. The method of claim 1, wherein the display device includes an electrophoretic display.

3. An apparatus for updating a bistable, electro-optic display device, comprising:

a first unit to generate synthesized pixel data from pixels of an image and pixels of a previous image;

a second unit to compare a first pixel of the image with a corresponding pixel of the previous image to determine if one of a first and a second condition is true, and to select a monochrome update mode, a pen update mode, and a gray-scale update mode as a first update mode when the first condition is true, a pen update mode as the first update mode when the second condition is true the second condition being determined only when the first condition is not true, and a gray-scale update mode as the first, update mode when both of the first and the second conditions are not true, and to compare a second pixel of the image with a corresponding pixel of the previous image to determine if one of a third and a fourth condition is true, and to select the monochrome update mode as a second update mode when the third condition is true, the pen update mode as the second update mode when the fourth condition is true, the fourth condition being determined when the third condition is not true, and the gray-scale update mode as the second update mode when both of the third and fourth conditions are not true;

a first pipeline unit to determine a waveform for the first pixel of the image in accordance with the first update mode and to transmit the waveform as impulse data to the display device during a first period; and a second pipeline unit to determine a waveform for the second pixel of the image in accordance with the second update mode and to transmit the waveform as impulse data to the display device during a second period, wherein the first condition is that each of the first pixel of the image and the corresponding pixel of the previous image is white or black, wherein the second condition is that the first pixel of the image is white or black, wherein the third condition is that each of the second pixel of the image and the corresponding pixel of the previous image is white or black, wherein the fourth condition is that the second pixel of the image is white or black, wherein the first update mode is different from the second update mode, wherein the first period and the second period at least partially coincide in time, wherein each of the first pipeline unit and the second pipeline unit is used to update an arbitrary display region of the display device, and wherein a number of the pipelines allocated for the gray-scale update mode is larger than a number of the pipelines allocated for the monochrome update mode.

4. The apparatus of claim 3, wherein the display device includes an electrophoretic display.

5. A bistable, electro-optic display device, comprising:

a first unit to generate synthesized pixel data from pixels of an image and pixels of a previous image;

a second unit to compare a first pixel of the image with a corresponding pixel of the previous image to determine if one of a first and a second condition is true, and to select a monochrome update mode as a first update mode when the first condition is true, a pen update mode as the first update mode when the second condition is true, the second condition being determined only when the first condition is not true, and a gray-scale update mode as the first update mode when both of the first and second conditions are not true, and to compare a second pixel of the image with a corresponding pixel of the previous image to determine if one of a third condition and a fourth condition is true, and to select the monochrome update mode as a second update mode when the third condition is true, the pen update mode as the second update mode when the fourth condition is true, the fourth condition being determined only when the third condition is not true, and the gray-scale update mode as the second update mode when both of the third and fourth conditions are not true; and a first pipeline unit to determine a waveform for the first pixel of the image in accordance with the first update mode and to transmit the waveform as impulse data to the display device during a first period; and a second pipeline unit to determine a waveform for the second pixel of the image in accordance with the second update mode and to transmit the waveform as impulse data to the display device during a second period, wherein the first condition is that each of the first pixel of the image and the corresponding pixel of the previous image is white or black, wherein the second condition is that the first pixel of the image is white or black, wherein the third condition is that each of the second pixel of the image and the corresponding pixel of the previous image is white or black, wherein the fourth condition is that the second pixel of the image is white or black, wherein the first update mode is different from the second update mode, and wherein the first period and the second period at least partially coincide in time, wherein each of the first pipeline unit and the second pipeline unit is used to update an arbitrary display region of the display device, and wherein a number of the pipelines allocated for the gray-scale update mode is larger than a number of the pipelines allocated for the monochrome update mode.

6. The display device of claim 5, wherein the display device is an electrophoretic display device.

* * * * *